United States Patent [19]

Curr et al.

[11] Patent Number: 4,540,433

[45] Date of Patent: Sep. 10, 1985

[54] TREATMENT OF FERROMANGANESE

[75] Inventors: Thomas R. Curr; Ingrid E. Schmidt, both of Johannesburg, South Africa

[73] Assignee: Council For Mineral Technology, Randburg, South Africa

[21] Appl. No.: 538,498

[22] Filed: Oct. 3, 1983

[30] Foreign Application Priority Data

Oct. 4, 1982 [ZA] South Africa ..... 82/7253

[51] Int. Cl.[3] ..... C22B 4/00

[52] U.S. Cl. ..... 75/10 R

[58] Field of Search ..... 75/10–12, 75/65 EB

[56] References Cited

U.S. PATENT DOCUMENTS

| | | | |
|---|---|---|---|
| 3,347,766 | 10/1967 | Death | 75/10 R |
| 3,671,655 | 6/1972 | Adachi | 219/121 P |
| 3,684,667 | 8/1972 | Sayce | 75/10 R |

OTHER PUBLICATIONS

Donyina et al., "Treatment of Ferro-Manganese Fines in an Extended Arc Flash Reactor", *CIM Bulletin,* vol. 75, No. 847, pp. 132–137 (1982).

*Primary Examiner*—Peter D. Rosenberg

*Attorney, Agent, or Firm*—Finnegan, Henderson, Farabow, Garrett & Dunner

[57] ABSTRACT

A method of treating ferromanganese alloys in a suitable reactor wherein the feed material is heated by a transferred-arc thermal plasma and is fed directly to the reactor bath. Accordingly, the molten bath defines a reaction zone and at least a part of the molten bath defines a lower electrode surface for the arc. In particular, ferromanganese alloy fines may be remelted to form a physically more massive form of the alloy and additionally may be refined by the addition of suitable metal oxides to yield a product wherein the content of at least silicon or carbon is lowered.

15 Claims, No Drawings

TREATMENT OF FERROMANGANESE

THIS INVENTION relates to the treatment of ferromanganese alloys which have been partially or fully processed and which may be in a basically unacceptable physical form such as the form of "fines", to yield ferromanganese alloys with improved physical forms and/or chemical composition.

Two basic processes which are applicable to the treatment of ferromanganese alloys include the remelting of fines or other physically unacceptable forms of the alloys, and the refining of the alloys in order to obtain a product with a lower carbon or silicon content than is initially produced.

When conventional submerged arc furnaces are employed for the above described processes, various problems become manifest. For example, in the process in which refining takes place, it is extremely difficult, if at all possible, to exclude the carbonaceous reductant material from the reaction zone. One reason for this is that, in any event, the electrodes of a submerged arc furnace are made of carbonaceous material which is in close physical contact with the reaction mass and thus adds carbon to the system.

Melting and refining in a submerged-arc furnace takes place beneath a burden of feed material which automatically feeds into the reaction zone under the influence of gravity. This type of feeding denies any sort of reasonable control over the rate at which the raw materials are fed to the reaction zone. Control of the conditions in the reaction zone cannot thus be exercised to any appreciable degree.

Also, in the case of finely sized materials, it is often inadvisable to feed such materials to a sumberged-arc type of furnace unless they are briquetted or otherwise agglomerated in order to maintain a suitable porosity throughout the burden. This porosity is required so that the product gases from the reaction zone may smoothly pass through the burden. Failure to maintain a suitable porosity usually results in a building up of gas pressure within the burden followed by an explosive release of this gas, commonly known as an eruption.

The presence of a high proportion of electrically conductive metal fines in the burden of existing submerged-arc furnaces results in lowered furnace resistance and hence lower power operation at maximum current.

The use of existing three-phase a.c. open-arc furnaces such as steelmaking electric-arc furnaces for the remelting and refining of ferromanganese alloy "fines" is not currently practised. The small size (typically less than 6 mm) of the ferromanganese "fines" would mean that the side walls would be exposed to the "arc flare" from the three electrodes throughout the process which is considered bad practice.

It is the object of this invention to provide an improved method of treating ferromanganese alloys in which the disadvantages outlined above are, at least to some extent, obviated.

In accordance with this invention, there is provided a method of treating ferromanganese alloys in which the alloy is treated in a suitable reactor having a substantially non-oxidizing atmosphere whilst being heated by a transferred arc thermal plasma, as herein defined, wherein the treatment is primarily accomplished in the said bath; and wherein feed material is fed directly to the bath.

A thermal plasma arc is defined as: a plasma sustained by the passage of an electric current; in which the ion temperature lies in the range 5000K to 60000K; which is bounded by at least two electrode surfaces; and to which controlled amounts of material may be added.

An electrode surface is defined as the interface between matter in a plasma state and matter in a solid or liquid state across which interface an electric current is passing. A transferred-arc thermal plasma is defined as a thermal plasma arc in which at least one electrode surface comprises at least a part of the surface of a continuous molten bath of process material, and wherein the bath is primarily liquid and may include some solid feed material.

The above definitions shall apply whenever the terms therein defined and used in this specification, including the accompanying claims.

A further feature of the invention provides for the feed material to pass through the area defined by the thermal plasma arc in order to expedite feeding to said bath.

Still further features of the invention provide for air to be substantially excluded from the system to avoid oxidation of consumable electrodes and unwanted oxidation of metal by providing a suitable sealed closed reactor and optionally by purging the feed materials with inert gas such as Argon. The furnace may be operated at a slight positive pressure with respect to prevailing atmospheric pressure in order to enhance the exclusion of air which may, otherwise, tend to leak into the reactor. This can be achieved by restricting the flow passage for off-gases.

The feed materials are fed, in their solid state, in suitable proportions, directly to the molten bath in the hearth of the reactor.

It will be understood that the reactor in which the melting, refining, or reduction of feed materials takes place could assume many different physical forms and that the lower regions may embody a number of electrodes for establishing an electrical connection to the molten bath and may additionally employ a number of cooled essentially non-consumable electrodes or consumable electrodes above the bath. Also, the electrodes may be arranged in any geometric relationship which provides the required transferred-arc thermal plasma, and the electrodes above the bath could be made to precess at a preselected speedor to oscillate at a preselected frequency.

In all cases, the feed rate of optionally pre-mixed materials and the energy input are adjusted to achieve and maintain desired temperatures of slag and molten metal. In cases where fluxing additions are made to the feed materials, these are chosen so that a suitable liquidus temperature and chemical state (such as the ratio of calcium oxide to silica) of the slag results. Carbonaceous reductants may optionally also be included.

From the above it will be understood that the process of this invention can be employed to remelt ferromanganese alloy fines (defined for the purposes of this specification as being less than 6 mm in particle size), resulting from the physical sizing and handling of ferromanganese products to yield a physically more massive form of the alloy, and optionally to refine this alloy, or indeed any other ferromanganese alloy, suitable for refining, by the addition of at least one suitable metal oxide to yield a product wherein the content of at least silicon or carbon is lowered. The metal oxide is mixed with the feed material as an oxidant generally without the addition of a carbonaceous reductant. The metal oxide is preferably an oxide of at least iron or manganese and is preferably chosen from the group of materials comprising ore, discard slag and gas plant dust.

The following examples illustrate the operation of the invention in the three basic types of operation concerned.

EXAMPLE 1 REMELTING OF HIGH CARBON FERROMANGANESE METAL FINES USING A NON-CONSUMABLE ELECTRODE

Tests were conducted in a 1400 kV. A furnace manufactured by Tetronics Research and Development Limited (TRD) substantially in accordance with their issued British Patent Nos. 390351/2/3 and 159526. The furnace generated a transferred-art plasma which fulfilled the criteria above and employed a single, water-cooled, non-consumable plasma gun located centrally above the molten bath. The gun was of the precessive type and a precession speed of 50 RPM was employed throughout these tests. A direct-current power supply was employed in which the molten bath formed the anodic contact while the plasma gun comprised the cathode.

The furnace was operated at slightly positive pressures (20 Pa. gauge) and the feed material consisted solely of ferromanganese metal fines as detailed in Table 1. These metal fines contain a small percentage of slag which is included in the manganese, iron and silicon reported analyses given in Table 1. The liquid products were tapped continuously in two compaigns lasting a total of 8.0 hours at between 400 and 500 kW gross power input which yielded a specific energy consumption of 795 kWh/t of metal product. The relatively small scale of the furnace resulted in a thermal efficiency of 75 percent compared with an expected 90 percent on a larger scale, so that the specific energy consumption would more closely approach the theoretical value on a larger scale. The masses of feed, metal, slag and dust, together with the metal analyses are given in Table 2. The loss of manganese in the dust stream comprises only 0.65 percent of the input manganese to the furnace, while 8.3 percent of the feed was tapped as slag.

TABLE 1

| Ferromanganese Metal Fines | Raw material analyses (%) Mn | Fe | Si | C | S | P |
|---|---|---|---|---|---|---|
| Metal fines (50% 4 mm) | 75.5 | 14.5 | 0.68 | 6.95 | 0.006 | 0.07 |

TABLE 2

| Re-melting of ferromanganese metal fines (kg) Test no. | Feed | Metal | Slag | Dust |
|---|---|---|---|---|
| A | 1835 | 1389 | 131 | 7 |
| B | 3310 | 3153 | 297 | 13 |

| Metal Analyses | Mn | Fe | Si | C | S | P (% by mass) |
|---|---|---|---|---|---|---|
| A | 74.0 | 17.9 | 0.22 | 6.00 | 0.008 | 0.09 |
| B | 72.2 | 15.8 | 0.10 | 6.18 | 0.008 | 0.09 |

EXAMPLE 2 REMELTING OF HIGH CARBON FERROMANGANESE METAL FINES USING A CONSUMABLE ELECTRODE

Tests were carried out on a small d.c. 100 kV.A furnace equipped with a hollow graphite electrode as the cathode. The molten bath constituted the anode and electrical contact was established via three stainless steel anodes in the hearth refractory. The graphite electrode was free to move axially in order to vary the arc length, argon and/or nitrogen was injected down the electrode, and the feed was gravity fed into the bath directly. A total of 180 kg of metal fines were fed to the furnace and the product and feed analyses appear in Table 3. The specific energy consumption was comparable to the value achieved in Example 1 after adjusting for the lower thermal efficiency of this smaller furnace (55%).

TABLE 3

| Analyses of feed and products for remelting campaign of ferromanganese metal fines Element | Feed metal % | Product metal (Average) % |
|---|---|---|
| Manganese | 73.7 | 75.32 |
| Iron | 13.5 | 17.08 |
| Silicon | 1.8 | 0.5 |
| Carbon | 6.6 | 5.75 |
| Sulphur | 0.025 | 0.01 |
| Phosphorus | 0.12 | 0.084 |

EXAMPLE 3 REFINING OF HIGH-CARBON FERROMANGANESE METAL FINES

These tests were carried out in a small d.c. 100 kV.A transferred-arc plasma furnace utilizing a water-cooled non-consumable plasma gun mounted centrally above the molten bath. The plasma gun only moved axially in order to alter the plasma arc length.

The furnace which had an outside diameter of 600 mm, and a wall thickness of 120 mm, was lined with a refractory material wherein the MgO content was approximately 95% The hearth was lined with the same material to a thickness of 300 mm and three stainless steel rods were used to make the d.c. (anode) electrical connection to the molten bath through the hearth refractory. The furnace was heated to a temperature of between 1750° C. and 1950° C. with an initial metal charge to establish the molten bath. The compositions of the raw materials are given in Table 4, together with the masses of each component actually fed to the furnace. Considerable refining was achieved in that the carbon and silicon contents of the metal dropped from 6.6 percent and 1.33 percent to 0.80 percent and 0.36 percent respectively.

TABLE 4

| Refining materials ANALYSES (% by mass) Material | Mn | Fe | $SiO_2$ | CaO | MgO | $Al_2O_3$ | C | Si | Mass of feed (kg) |
|---|---|---|---|---|---|---|---|---|---|
| Mamatwan ore | 36.7 | 5.84 | 8.57 | 16.7 | 3.01 | 0.19 | — | — | 16.5 |
| Dolomite | 0.81 | 0.57 | 1.77 | 30.4 | 20.0 | 0.35 | — | — | 3.3 |
| FeMn Metal | 74.7 | 13.8 | — | — | — | | 6.6 | 1.33 | 33.0 |

TABLE 4-continued

| | Refining materials | | | | | | | | |
|---|---|---|---|---|---|---|---|---|---|
| | ANALYSES (% by mass) | | | | | | | | |
| Material | Mn | Fe | $SiO_2$ | CaO | MgO | $Al_2O_3$ | C | Si | Mass of feed (kg) |
| fines | | | | | | | | | |

EXAMPLE 4 THE REFINING OF HIGH CARBON FERROMANGANESE

Tests were carried out in refractory lined vessels using a hollow graphite electrode as the cathode and the molten bath as the anode at powers of 30 kW, yielding bath temperatures from 1590° C. to 1620° C. The feed consisted of a synthetic ore (prepared previously) and ferromanganese metal fines with a metal:ore ratio of 2:1. The analyses of the feed materials are given in Table 5 and the results of the refining tests showing a lowering of the carbon and silicon contents of the metal for each of the synthetic ore compositions are given in Table 6.

TABLE 5

| | Feed material analyses (%) | | | | | |
|---|---|---|---|---|---|---|
| | | | Mn | Fe | Si | C |
| Ferromanganese metal fines | | | 73.8 | 13.4 | 0.8 | 6.6 |
| | MnO | FeO | MgO | CaO | SiO | $Al_2O_3$ |
| Synthetic ore A | 54.6 | 13.7 | 4.22 | 10.7 | 10.8 | 0.82 |
| Synthetic ore B | 52.1 | 12.2 | 3.6 | 17.5 | 8.9 | 0.93 |

TABLE 6

| | Refining test results | | | | |
|---|---|---|---|---|---|
| | Mn Recovery | Metal Analyses (%) | | | |
| Synthetic Ore | % | Mn | C | Si | S |
| A | 80 | 67 | 3.0 | 0.17 | 0.01 |
| B | 82 | 70 | 1.8 | 0.12 | 0.01 |

It is to be understood that the method according to this invention and exemplified above may also include the use of an alternating current power supply to generate the transferred arc thermal plasma.

The invention therefore provides an effective and simple process for refining, melting and otherwise treating ferromanganese alloys.

What we claim as new and desire to secure by Letters Patent is:

1. A process for remelting ferromanganese alloy fines to produce an improved solid ferromanganese alloy product comprising melting the ferromanganese alloy fines in a furnace bath that is heated by a transferred arc thermal plasma having a plasma generating gun positioned above the bath, said gun serving as the cathode with the plasma forming gas being an inert gas introduced above the bath by said gun and said molten alloy in the furnace bath being in direct electrical communication with an electrode serving as the anode, feeding ferromanganese alloy fines directly to the bath at a rate that maintains a molten condition in the bath, followed by tapping and solidification of the molten alloy to form said improved product.

2. The method of claim 1 wherein the feed material passes through the area defined by the thermal plasma.

3. The method of claim 1 in which the furnace is operated with the interior thereof at a slight positive pressure with respect to prevailing atmospheric pressure.

4. The method of claim 1 in which the feed material added to the bath is purged with inert gas prior to entering the bath.

5. The method of claim 1 in which the transferred arc thermal plasma is generated by a direct current power supply.

6. The method of claim 1 in which the transferred arc thermal plasma is generated by an alternating current power supply.

7. The method of claim 1 wherein the electrical communication between the electrode and the molten alloy in the bath is made by incorporating at least one electrode in the lower regions of the furnace bath.

8. The method of claim 1 wherein the plasma generating gun located above the bath includes at least one cooled and essentially non-consumable electrode.

9. The method of claim 1 wherein the plasma generating gun includes at least one consumable electrode.

10. The method of claim 1 wherein the plasma generating gun processes at a preselected speed.

11. The method of claim 1 wherein the plasma generating gun can oscillate at a preselected frequency.

12. The method of claim 1 wherein carbonaceous reductant is included in the feed.

13. The method of claim 1 wherein the molten ferromanganese alloy is refined to lower its carbon and/or silicon content by the presence of at least one suitable metal oxide in the molten bath.

14. The method of claim 13 wherein an oxide of iron or manganese is added to the feed.

15. The method of claim 1 including a suitable flux in the feed.

* * * * *